US006688348B2

(12) United States Patent
Fontenot

(10) Patent No.: US 6,688,348 B2
(45) Date of Patent: Feb. 10, 2004

(54) SUBMERGED FLOWLINE TERMINATION BUOY WITH DIRECT CONNECTION TO SHUTTLE TANKER

(75) Inventor: William L. Fontenot, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/288,934

(22) Filed: Nov. 5, 2002

(65) Prior Publication Data

US 2003/0084960 A1 May 8, 2003

Related U.S. Application Data

(60) Provisional application No. 60/332,774, filed on Nov. 6, 2001, and provisional application No. 60/332,782, filed on Nov. 6, 2001.

(51) Int. Cl.[7] ..... B65B 1/04

(52) U.S. Cl. ..... 141/387; 141/388; 141/382; 141/279

(58) Field of Search ..... 141/387, 388, 141/279, 382; 441/3, 4, 5

(56) References Cited

U.S. PATENT DOCUMENTS

| | | | | | |
|---|---|---|---|---|---|
| 3,466,680 | A | * | 9/1969 | Schirtzinger | 441/5 |
| 3,641,602 | A | * | 2/1972 | Flory et al. | 441/5 |
| 3,735,435 | A | * | 5/1973 | Mikulicic et al. | 441/5 |
| 3,750,723 | A | * | 8/1973 | Schirtzinger | 441/5 |
| 3,799,097 | A | * | 3/1974 | Robertson | 114/294 |
| 3,979,785 | A | * | 9/1976 | Flory | 441/5 |
| 4,423,984 | A | | 1/1984 | Panicker et al. | |
| 4,793,737 | A | | 12/1988 | Shotbolt | |
| 4,802,431 | A | * | 2/1989 | Pollack | 114/230.13 |
| 5,007,482 | A | * | 4/1991 | Forsyth et al. | 166/345 |
| 5,456,622 | A | * | 10/1995 | Breivik et al. | 441/3 |
| 5,582,252 | A | * | 12/1996 | Richmond et al. | 166/352 |
| 5,639,187 | A | | 6/1997 | Mungall et al. | |
| 5,816,183 | A | | 10/1998 | Braud et al. | |
| 5,944,448 | A | * | 8/1999 | Williams | 441/3 |
| 6,109,833 | A | | 8/2000 | Savy | |
| 6,206,742 | B1 | | 3/2001 | Bull et al. | |
| 6,415,828 | B1 | * | 7/2002 | Duggal et al. | 141/387 |
| 2002/0177375 | A1 | * | 11/2002 | Cottrell et al. | |

FOREIGN PATENT DOCUMENTS

| | | |
|---|---|---|
| GB | 2335723 | 9/1999 |

* cited by examiner

*Primary Examiner*—Gene Mancene
*Assistant Examiner*—Khoa D. Huynh
(74) *Attorney, Agent, or Firm*—Gary L. Bush; Andrews Kurth

(57) ABSTRACT

A submerged flowline termination buoy supports flowlines below the sea's dynamic wave zone. An export hose, connected to the flowline at a submerged connection assembly which is supported from the termination buoy, is selectively connected to a dynamically positioned shuttle tanker above the buoy. The export hose is allowed to weathervane and is marked with a marker buoy when it is not connected to the shuttle tanker. The marker buoy is anchored to the export hose with a swivel to allow uninterrupted weathervaning of the hose.

5 Claims, 2 Drawing Sheets

SUBMERGED FLOWLINE TERMINATION BUOY WITH DIRECT CONNECTION TO SHUTTLE TANKER

CROSS REFERENCE TO RELATED APPLICATION

This non-provisional patent application claims priority from provisional application No. 60/332,774 filed Nov. 6, 2001 and Prov. Appl. 60/332,782 filed Nov. 6, 2001.

BACKGROUND OF THE INVENTION

1. Field of the Invention

This invention relates generally to an offloading system by which hydrocarbon product is transferred from an offshore storage facility to a shuttle tanker. In particular, the offshore storage facility is a deepwater Floating Production Storage and Offloading vessel (FPSO) or a Tension Leg Platform or a SPAR Buoy where hydrocarbon product such as crude oil is temporarily stored after production from subsea wells.

2. Description of the Prior Art

In deep water operations, certain operational considerations make it desirable to offload hydrocarbons from a production and/or storage facility by running a pipeline to an offloading system, such as a CALM buoy, where a shuttle tanker may be moored and connected to a loading hose for filling its tanks with hydrocarbon products such as crude oil.

In a prior system described in U.S. Pat. No. 6,415,828 B1 (Duggal, et al), a product transfer system is disclosed in which a rigid or flexible pipeline from a FPSO or platform or the like extends in the sea above the sea bed for about a nautical mile where it terminates close to a CALM or SALM buoy, and where it is fluidly coupled to a flexible hose at a Flowline Termination Buoy (FTB) which is positioned by anchor legs below the wave kinematic zone. The other end of the flexible hose is fluidly coupled to a product swivel mounted on the single point mooring (SPM) buoy such as a CALM or a SALM. A shuttle tanker is moored to the SPM buoy by a hawser secured to a rotatable portion of the CALM buoy. A hose from a rotatable output of the product swivel connects to the shuttle tanker to complete the product flow path from the FPSO (or platform) to the shuttle tanker.

The prior system described above requires a SPM for shuttle tankers that do not have dynamic positioning systems on board and require mooring and fluid transfer from the SPM buoy. Nevertheless, certain tankers that do not need a mooring system to a SPM buoy, but nevertheless require connection to the pipeline which extends from the storage facility. Such connection should be at a submerged location below the wave kinematic zone as described in the above-mentioned U.S. Pat. No. 6,415,828.

3. Identification of Objects of the Invention

A primary object of the invention is to provide a submerged termination buoy (FTB) for coupling of an end of a pipeline from an offshore hydrocarbon storage facility to a marine hose for direct coupling with a shuttle tanker without the need for an intermediate SPM buoy.

Another object of this invention is to provide a transfer arrangement by which a fluid flowpath from an offshore storage facility to a shuttle tanker is provided with a pipeline marine hose connection at a Flowline Termination Buoy (FTB) kinematic zone and where the marine hose is connected to the shuttle tanker (especially, a dynamically positioned tanker) without the need for a SPM buoy.

SUMMARY

The objects identified above along with other advantages and features are provided in a transfer arrangement including a Flowline Termination Buoy (FTB) moored to the sea floor that is used to support and/or terminate one or more flowlines near the ocean surface, but deep enough below the wave kinematic zone such that the flowlines are not subjected to damaging fatigue cycles. If multiple pipelines from the storage facility are required, multiple hoses which are fluidly coupled to the pipelines at the FTB may be fluidly coupled to a Hose Tee Buoy to a single floating hose string which can be fluidly coupled to the dynamically positioned shuttle tanker. A marker buoy is connected to the single floating hose string via a swivel, so that when the hose string is not connected to a tanker, the upper part of the hose string can weathervane according to sea conditions.

BRIEF DESCRIPTION OF THE DRAWINGS

The objects, advantages and features of the invention will become more apparent by reference to the drawings which are appended hereto and wherein an illustrative embodiment of the invention is shown, of which.

DETAILED DESCRIPTION OF THE PREFERRED EMBODIMENT OF THE INVENTION

Figure 1:
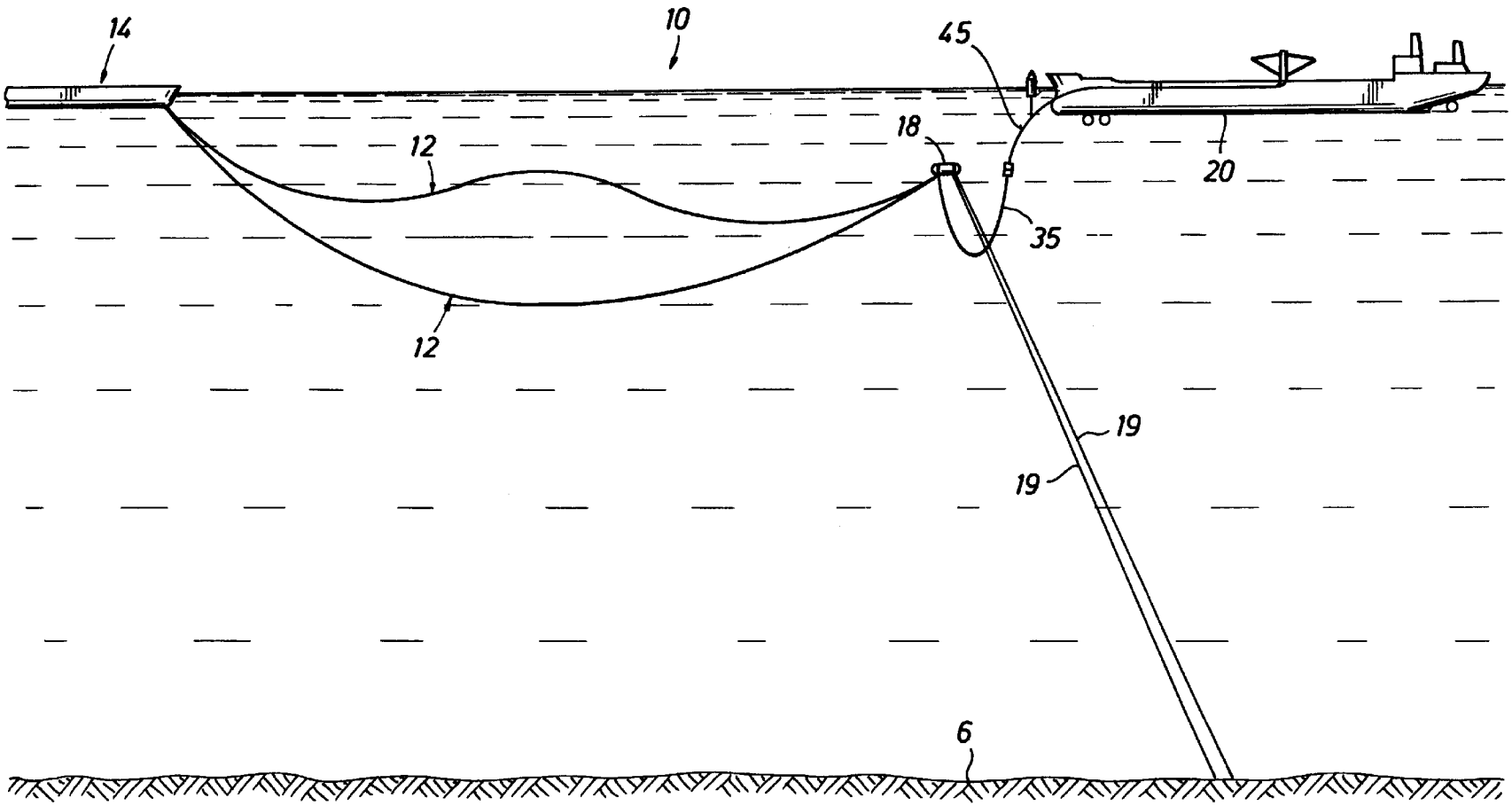
FIG. 1 is a schematic illustration of an arrangement of the invention where an end of a pipeline from a FPSO or production platform is supported by a tethered submerged Flowline Termination Buoy (FTB) with a flexible marine hose fluidly connected between the end of a pipeline and a dynamically positioned tanker.

FIG. 1 shows the general arrangement 10 of an embodiment of this invention where one or more pipelines 12 are fluidly connected between a storage facility such as a FPSO or platform 14 to a shuttle tanker 20, particularly a tanker equipped with a dynamic positioning system. The pipelines may have buoyancy modules attached along the run of the pipeline and may achieve different depth profiles (as suggested by the illustration of FIG. 1) as a function of distance from the FPSO 14 if desired. The pipelines may also extend from a sea floor storage facility. Marine hoses or flexible flowlines 35 or flowline 45 (see also, FIG. 2) are fluidly connected to the pipeline 12 at connector assemblies 25 supported by FTB 18. The FTB 18 is moored to the sea floor 6 by tension legs or taut chain legs 19 (See chain legs 19*a*, 19*b* of FIG. 2).

The pipelines 12, preferably steel tubular members, may have floatation attached to them along their path from FPSO 14 or other storage facility to the FTB 18 to prevent excessive sagging due to their heavy weight, so that they do not touch the sea floor. Pipelines from a sea floor storage facility may not need such flotation. The pipelines may be steel tubular members which are joined end to end by welding as is known in the art of pipeline construction. Alternatively, the pipeline may be fabricated with composite materials. They typically run at least one nautical mile to the vicinity of the FTB 18, but are submerged beneath the sea surface 4 at a depth so that shuttle tankers can maneuver between the FPSO 14 and the FTB 18 without fear of fouling the pipelines 12. Steel pipelines are rigid in the sense that they are continuous steel tubular members, but of course such a steel pipeline has flexibility due to their great weight and the inherent flexibility of a long spaghetti-like steel tubular string. Although the FTB 18 is shown positioned between the FPSO 14 and the tanker 20, it may be positioned to the far side of tanker 20 as shown in FIG. 2.

Figure 2:
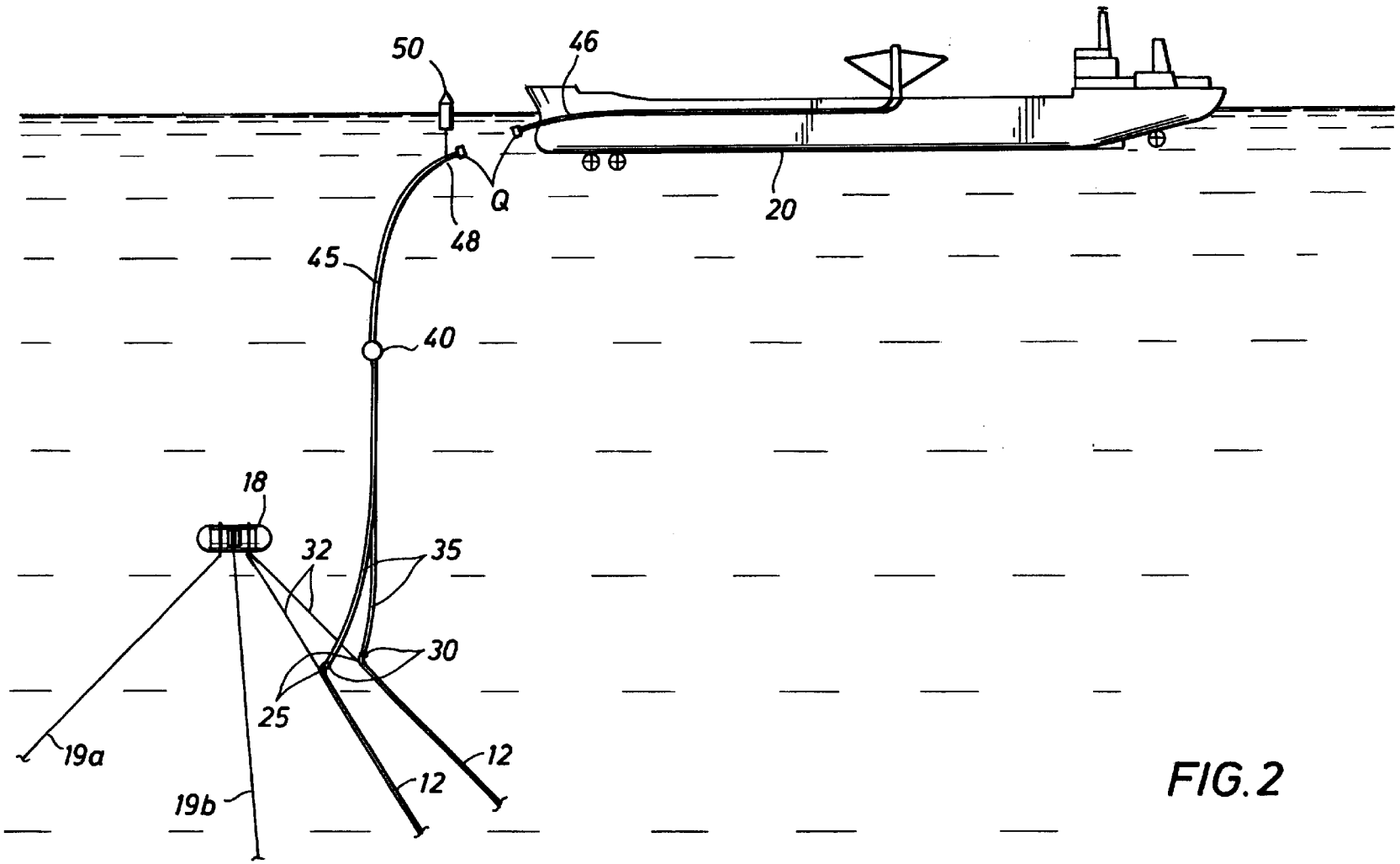
FIG. 2 is a schematic illustration of the invention showing more detail of the connection and disconnection of the marine hose coupling to the dynamically positioned shuttle tanker.

FIG. 2 shows that the ends of pipeline 12 are supported by connection assemblies 25 which are connected to FTB 18 by tension members such as chains 32. The connection assemblies 25 are preferably gooseneck assemblies like those described in the above mentioned U.S. Pat. No. 6,415,828 which is incorporated herein by reference. Ball valves 30 couple lower ends of marine hose strings 35 to coupling assemblies 25.

Although FIG. 2 shows the pipeline 12 connected via suspension assemblies 25 supported by chains 32 from FTB 18, a connection means can be mounted directly on FTB 18 for coupling the ends of pipelines 12 to the lower ends of hoses 35.

Advantageously, hoses 35 are combined into a single floating hose 45 via a hose tee buoy 40. A marker buoy 50 is attached to an upper end of floating hose 45 with a swivel 48 to allow uninterrupted weathervaning of the hose 48 when it is not connected to shuttle tanker 20.

A Quick Connect/Quick Disconnect coupling Q may be provided to rapidly couple hose 45 to a tanker loading hose 46. Other conventional hose couplings may be used where rapid connection and disconnection are not required or where reduced cost is important. Ball valves 30 may be closed prior to disconnection of hose 48 from hose 46. Although a floating hose is illustrated in FIG. 2, other hoses which do not provide for weathervaning of the hose during uncoupling from the tanker may be used. Retrieval from below the water surface may be advantageous if hose fatigue due to weathervaning were a problem.

As described above, the arrangement provides for pipeline coupling to a shuttle tanker, especially a dynamically positioned shuttle tanker, without the need for a SPM buoy for mooring and fluid transfer.

What is claimed is:

1. An offshore arrangement comprising, a shuttle tanker (20) having a tanker loading hose (46) with a loading end, a submerged flowline termination buoy (18) positioned in proximity to said shuttle tanker, said flowline termination buoy (18) being coupled to the sea floor (6) by mooring legs (19), a pipeline (12) extending from a hydrocarbon storage facility (14) to a position in proximity to said submerged flowline termination buoy (18), a flexible hose (35, 45) having a first end and a second buoyant end, a submerged connection assembly (25) supported by said submerged flowline termination buoy (18), said assembly fluidly connecting said first end of said hose and said pipeline (12) with said second buoyant end of said flexible hose positioned in proximity of said loading end of said loading hose (46) above said sea floor (6), and a connector assembly (Q) cooperatively arranged at said second buoyant end of said flexible hose and at said loading end of said tanker loading hose (46) for selectively fluidly connecting or disconnecting said flexible hose (35, 45) to said loading end of said tanker hose (46), wherein, said shuttle tanker (20) includes a dynamic positioning system for maintaining tanker position when said flexible hose (35, 45) is connected to said shuttle tanker.

2. An offshore arrangement comprising, a shuttle tanker (20) having a tanker loading hose (46) with a loading end, a submerged flowline termination buoy (18) positioned in proximity to said shuttle tanker, said flowline termination buoy (18) being coupled to the sea floor (6) by mooring legs (19), a pipeline (12) extending from a hydrocarbon storage facility (14) to a position in proximity to said submerged flowline termination buoy (18), a flexible hose (35, 45) having a first end and a second buoyant end, a submerged connection assembly (25) supported by said submerged flowline termination buoy (18), said assembly fluidly connecting said first end of said hose and said pipeline (12) with said second buoyant end of said flexible hose positioned in proximity of said loading end of said loading hose (46) above said sea floor (6), and a connector assembly (Q) cooperatively arranged at said second buoyant end of said flexible hose and at said loading end of said tanker loadinig hose (46) for selectively fluidly connecting or disconnecting said flexible hose (35, 45) to said loading end of said tanker hose (46), wherein said connector assembly (Q) includes quick connect/quick disconnect coupling elements disposed at said second buoyant end of said flexible hose (35, 45) and at said loading end of said tanker loading hose (46).

3. An offshore arrangement comprising, a dynamically positioned shuttle tanker (20) having a loading hose (46), a submerged flowline termination buoy (18) positioned in proximity to said dynamically positioned shuttle tanker, said flowline termination buoy being coupled to the sea floor (6) by mooring legs (19), at least one pipeline (12) extending from a hydrocarbon storage facility (14) to a position in proximity to said submerged flowline termination buoy (18), and a submerged connection assembly (25) supported by said submerged flowline termination buoy (18), said connection assembly having a fluid flow path which fluidly connects an end of said at least one pipeline to a first end of a flexible hose (35, 40), said flexible hose (35, 40) having a buoyant second end which is connected via a selectively operated fluid connection arrangement (Q) directly to said shuttle tanker (20).

4. The arrangement of claim 3 wherein, said end of said flexible hose (35, 40) and an end of said loading base (46) are positioned at a point above said sea floor (6).

5. The arrangement of claim 3 further comprising, a marker buoy (50) coupled to said buoyant second end of said hose (35, 40) by a swivel, whereby when said second end of said hose is not connected to said shuttle tanker (20), said hose is permitted to weathervane in response to environmental forces and said marker buoy marks a position of said hose.

* * * * *

UNITED STATES PATENT AND TRADEMARK OFFICE

CERTIFICATE OF CORRECTION

PATENT NO. : 6,688,348 B2
DATED : February 10, 2004
INVENTOR(S) : Fontenot

It is certified that error appears in the above-identified patent and that said Letters Patent is hereby corrected as shown below:

Column 4,
Line 24, delete “loadinig” and insert -- loading --

Signed and Sealed this

Thirtieth Day of March, 2004

JON W. DUDAS
*Acting Director of the United States Patent and Trademark Office*